US005123177A

United States Patent [19]

Koetter et al.

[11] Patent Number: 5,123,177

[45] Date of Patent: Jun. 23, 1992

[54] WOOD CURING KILN

[75] Inventors: Thomas C. Koetter, Borden; Richard A. Koetter, Floyd-Knobs, both of Ind.

[73] Assignee: Forestor-Koetter, Eckhart, Ind.

[21] Appl. No.: 607,112

[22] Filed: Nov. 2, 1990

[51] Int. Cl.[5] ..... F26B 19/00

[52] U.S. Cl. ..... 34/69; 34/92; 34/191; 34/242

[58] Field of Search ..... 34/16.5, 16.8, 32, 92, 34/60, 191, 38, 68, 242, 69

[56] References Cited

U.S. PATENT DOCUMENTS

| | | | |
|---|---|---|---|
| 2,802,281 | 8/1957 | Stone | 34/16.5 X |
| 3,149,929 | 9/1964 | Asplund | 34/16.5 |
| 4,893,415 | 1/1990 | Moldrup | 34/16.5 |

*Primary Examiner*—Henry A. Bennett

*Attorney, Agent, or Firm*—Watson, Cole, Grindle & Watson

[57] ABSTRACT

In a wood curing kiln, a chamber is sealed to retain a negative pressure with respect to the ambient and for storing stacked lumber to be cured and having a concrete floor with embedded heating pipes for circulating heated water to heat the concrete floor to a temperature preventing condensation thereon, and with means for circulating heated air within the chamber and through the stacked lumber to remove moisture therefrom and with the chamber being constantly vented to remove moist air and maintain the negative pressure within the chamber. A tarp is suspended from the ceiling of the chamber above the stacked lumber to enable the tarp to be lowered to cover and seal the top of the stacked lumber so that the heated air flows across the top of the tarp and down into and through an end of the stacked lumber.

19 Claims, 4 Drawing Sheets

WOOD CURING KILN

BACKGROUND OF THE INVENTION

1. Field of the Invention

This invention relates to method and apparatus for curing wood, and in particular to such method and apparatus which prevents condensation on the kiln floor, enhances the air flow around and through the stacked wood, uses swing-up doors to provide sealing reducing heat loss through condensation control and provides a constant negative pressure in the kiln to enable constant, slow venting to the ambient.

2. Related Art

In conventional wood kilns fans are used to force air through the stacked lumber within a sealed chamber, and baffles are required to ensure that the air is forced through the stacked lumber. In many conventional wood kilns such baffling is so insufficient that a considerable amount of the air is forced above the stacked lumber and not through it as is desired. One solution that has been adopted is to increase the amount of forced air flowing in the kiln, which is inefficient as it wastes electrical power and the heat rise caused by the fan blowers may actually result in a sufficient temperature increase within the kiln that it is difficult to maintain the proper temperature control during the wood curing cycle. Venting air to reduce the temperature may result in too dry air in the kiln and damage the wood. Vaporization normally provides natural cooling, but may be insufficient with certain types and thicknesses of wood such as 2 inch thick oak, for example. With such wood the rate of vaporization is too slow to provide adequate cooling to control the temperature of the air in the kiln.

Drying lumber differs from drying anything else due to the thickness of the wood. For example, if it is desired to dry wood down to an average of 5 or 6 percent moisture content, the wood is really 3 or 4 percent moisture content on the outside and 6 to 8 percent moisture content on the inside. The dry outside of the wood is in a condensed condition and the wet inside is in an expanded condition. If such wood were split, it would "pop" and be useless. Thus, it is necessary to equalize the lumber. The normal process for equalizing lumber is to dry it down to 3 percent and at this point the outside will be dry and the inside will be at about 6 percent. Most wood kilns release steam into the kiln and bring the humidity back up, which puts moisture back into the lumber that will equalize it to the same moisture content as the inside. The provision of steam for such equalization represents an additional cost of curing the lumber.

Another problem associated with conventional wood kilns is that the use of track-type doors causes sealing problems as the door never returns to the same position from which it started when it is opened and then closed as the seal has molded itself to the previous position the door was in when it was closed. As most conventional wood curing kilns operate with a positive pressure in the kiln it is necessary to have rather tight sealing around the kiln doors.

Most conventional wood kilns operate on a set schedule for drying the wood. Such schedules require two thermal elements to monitor the moisture and the temperature or heat in the kiln. Normally sample pieces of wood are inserted into the slits where the bolsters are in the stacked wood and these wood samples are then periodically weighed to determine the moisture content of the wood.

Finally, conventional wood kilns produce a great amount of condensation on the floor of the kiln and such condensation, because of the chemicals it contains, will seriously deteriorate the kiln floor. The periodic repair or replacement of the kiln floor is expensive and results in downtime of the kiln.

It is common practice in conventional wood kilns to equalize the moisture content of the stacked wood therein by introducing steam to accelerate the equalization process. While such use of steam does accelerate the equalization process, it also represents an added expense to the wood curing process.

SUMMARY OF THE INVENTION

A primary feature of the invention is to prevent or limit the formation of condensation on the kiln floor by the simple expedient of heating the kiln floor by, for example, circulating heated water from a heat exchanger through coils embedded in the concrete floor of the kiln to raise the temperature of the concrete floor surface to approximately that of the heated air circulating in the kiln.

To overcome the problem of proper baffling of the air forced through the kiln, the present invention provides tarps which are placed on top of the lumber from the ceiling of the wood kiln and operate the fans in one direction to create a high pressure on top of the tarps and a low pressure underneath them, which holds the tarps onto the lumber. Thus, the air is directed across the "false ceiling" between the top of the tarps and the ceiling of the kiln and all of the air is forced through the stacked lumber in the kiln. In conventional kilns wherein the fans are run in both directions (alternately forward and reverse) the air is pulled through the fans, through the heating coils and some of the air exhausts directly to the outside of the kiln without ever going through the lumber. Thus, the method and apparatus of the invention provides a more efficient and less costly curing of the lumber without the use of expensive and complex baffling in the wood kiln to direct the forced air through the lumber.

Moreover, the greater amount of forced air required by conventional wood kilns requires an excessive amount of electrical motors and horsepower. For example, a 50,000/bf. conventional kiln may require seven 3 hp motors equivalent to 21 hp to operate the circulating fans. In the method and apparatus of the invention a 40,000/bf. kiln requires five 1½ hp motors equivalent to 7½ hp to obtain an adequate or desired airflow through the stacked lumber. This reduces the cost of electricity as well as controls the temperature rise in the kiln thereby reducing the venting requirements.

In the present invention instead of using steam to equalize the moisture content of the stacked lumber the air in the kiln is monitored. When there is a moisture content in the lumber equivalent to 4 percent equilibrium content in the lumber the vents are closed or the exhaust fan is turned off. It is thus known that the moisture content of the stacked lumber is 4 percent on the outside, but it is probably 7 or 8 percent on the inside, so the vents remain closed allowing the moisture content within the kiln to increase. The inside of the lumber is still releasing moisture, but the moisture content of the wood is being equalized as the released moisture is being absorbed by the outside of the wood. It takes approximately 24 to 36 hours to equalize the wood moisture content in accordance with the invention, whereas in conventional wood kilns it only takes 3 or 4 hours to equalize with steam. However, in the process in accordance with the invention the lumber does not shrink as much with the use of lower temperatures to dry it. In conventional kilns overdrying of the lumber and the subsequent addition of moisture using steam causes the wood to attain a different dimension than that before it was overdried. The method of the invention avoids such water content hysteresis problems.

In accordance with yet another feature of the invention, the doors to the bays of the wood-curing kiln are hinged at the top so as to swing upwardly and downwardly as opposed to being mounted on a track for sideways movement, for example. This type of hinged movement enables a better seal to be obtained when the bay doors are closed during operation of the wood kiln as it allows the bay doors to seat against their respective seals in essentially the same position. The design of the bay doors in accordance with the invention also enables a larger rubber seal to be used as opposed to that which could be used with a sliding door. A larger rubber or other flexible seal affords a greater degree of thermal isolation between the inner wall metal lining of the doors and the external portions of the door at the location of the seal thereby reducing condensation. With the wide seal in accordance with the invention, the aluminum door liner is brought from the inside out and terminated as close to the center of the seal as is possible. Aluminum is used as a door liner as it resists corrosion from the acids produced in the wood kiln during the operation thereof. However, because such a metal is highly thermally conductive, it is necessary to break off the aluminum in the middle of the door to prevent the aluminum from conducting cold into the kiln and thereby forming a condenser for the hot and humid ambient of the interior of the kiln.

A further feature of the invention is the maintenance of a constant negative pressure in the kiln instead of a positive pressure. This negative pressure further improves the efficiency and life span of the door seals and the entire kiln structure. Moisture in the form of steam, for example, will be prevented from egressing from the kiln through any cracks or openings due to the vacuum.

And yet a further feature of the invention is the placement of a wet paper towel over the dry bulb which provides a depression reading. The moisture in the kiln is dependent upon the moisture in the wood. By maintaining a constant and small amount of air exhausting from the kiln there is maintained a constant decreasing humidity. Such a procedure normally will result in a constant decrease in the moisture content of the wood, and thus it is not necessary to actually measure the wood moisture content by weighing a sample piece of wood in the kiln. The progressive decrease in the wood moisture content can actually be charted on a graph. This procedure works for most woods, but in some instances, for example with oak, it may be necessary to periodically actually weigh a sample of the wood to determine the moisture content thereof because of the lengthy curing time of oak and similar hard woods.

Heat to the kiln is provided by heating water in suitable coils, conducting the heated water to a heat exchanger and then causing the air in the kiln to circulate through the heat exchanger. The heating colis are located in a boiler outside but adjacent to the kiln. The boiler may be heated by gas, oil, electric or any other available fuel such as, for example sawdust, thereby reducing the cost of the fuel since sawdust is a by-product of wood processing operations and may be available at the site of the kiln.

Hot water is tapped from the heat exchanger and circulated through pipes embedded in the cement floor of the kiln to heat the surface of the concrete floor to prevent or limit the formation of condensation thereon as mentioned above.

BRIEF DESCRIPTION OF THE DRAWINGS

The above objects, features and advantages of the invention are believed to be readily apparent from the following description of a preferred embodiment representing the best mode of carrying out the invention when taken in conjunction with the following drawings, wherein.

DETAILED DESCRIPTION OF THE PREFERRED EMBODIMENT

Figure 1:
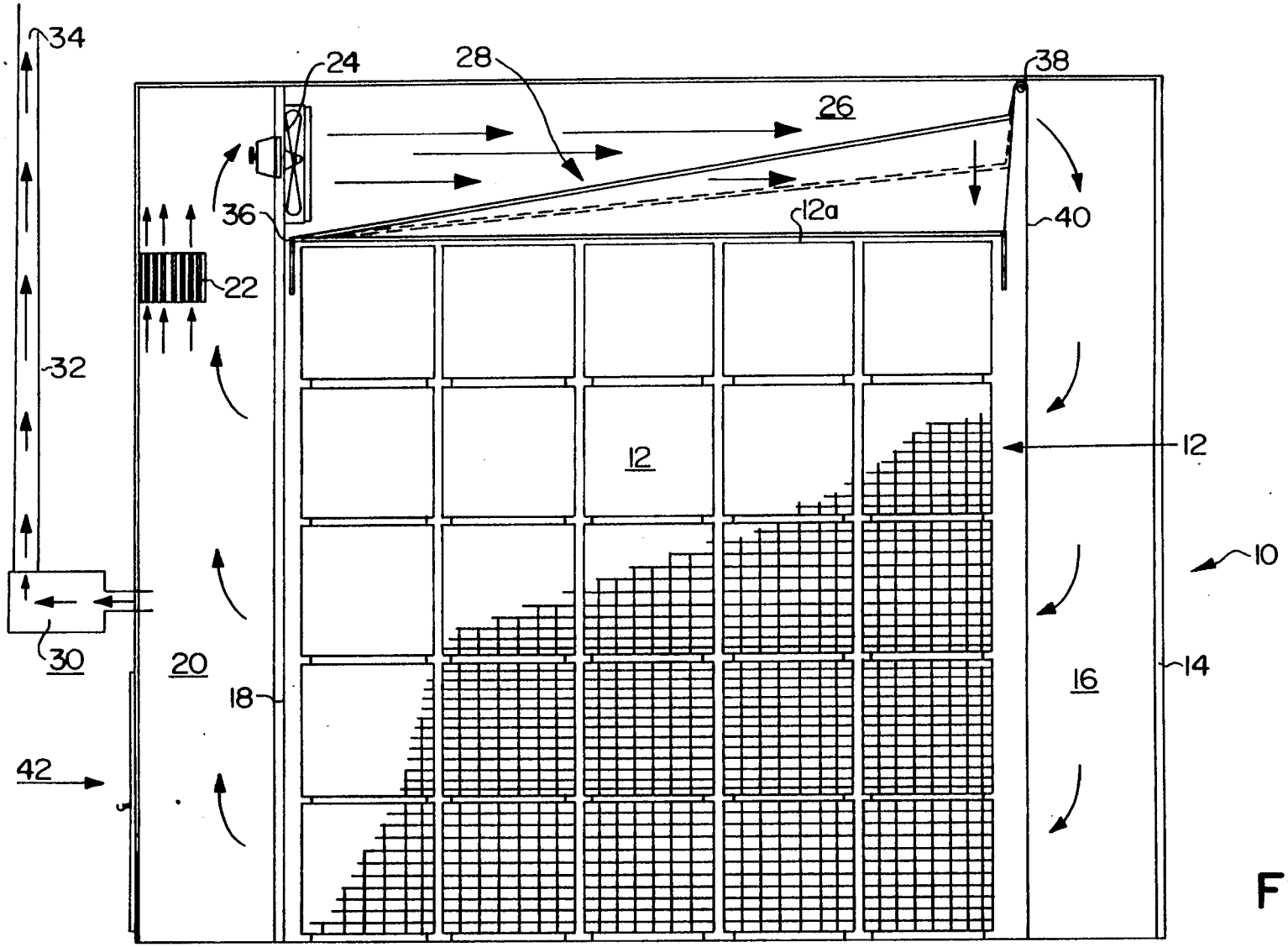
FIG. 1 is a combined side elevation view of a section of a wood kiln and diagrammatic layout of components of the wood kiln in accordance with a preferred embodiment of the invention.

FIG. 1 shows a side elevation view of typical kiln bay 10 with a 5×5 stack of lumber 12 to be dried. The lumber 12 is stacked in bay 10 by fork lifts through a hinged door 14 (see FIG. 3A). Bay 10 comprises a first ventilation passageway 16, stacked lumber 12, baffled wall 18 separating a second ventilation passageway 20 from stacked lumber 12, heat exchanger 22, exhaust circulating fan 24 which draws air from the second ventilation passageway 20 and through heat exchanger 22 and into third passageway 26 which is formed above tarp 28 and then back into first ventilation passageway 16. Exhaust fan 30 draws air from second ventilation passageway 20 through vent passageway 32 to exhaust kiln air into the ambient 34. Tarp 28 is anchored to the top of the rear of stack 12 as shown at 36 with free end of tarp 28 being suspended via a pulley and chain 40 so that tarp 28 can be raised from and lowered onto the top **12*a* of stack 12. During operation of circulating fan 24 tarp 28 is lowered onto the surface 12*a* of lumber stack 12, thereby forming a free passage of circulating air within second ventilating passageway 26 and then into third ventilating passageway 16 for circulation through lumber stack 10 to exit therefrom into first ventilating passageway 20**.

Walk-through door 42 is provided for access to the rear of the bay, thereby enabling access to the bay 10 without opening sealed door 14.

The components illustrated in FIG. 1 are part of a single bay, which may be approximately 30×40 feet. Additional bays formed in succession behind the bay shown in FIG. 1 may be utilized with each such bay being identical in structure and operation as the bay shown in FIG. 1.

Figure 2:
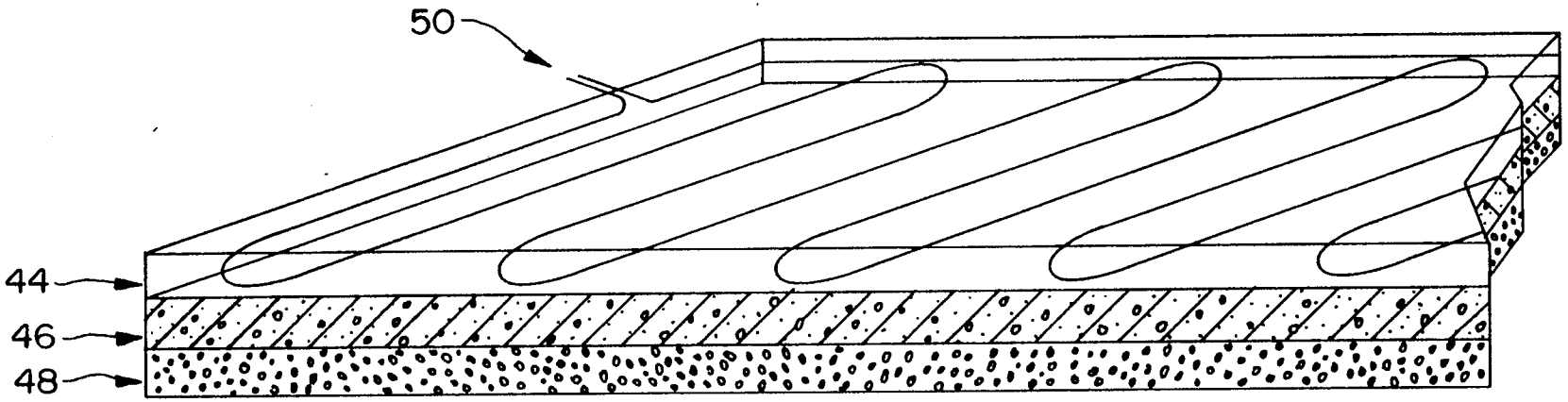
FIG. 2 is cut-away view of a portion of the cement floor of the kiln showing the embedment of the plastic pipe for heating the floor.

FIG. 2 shows a cut-away view of the heated concrete floor of bay 10. Heated concrete floor is formed over a concrete sub floor 46 and gravel base 48 in a manner known to those skilled in the wood kiln art. The composite structure of concrete floor 44, concrete sub-floor 46 and gravel 48 must be capable of not only supporting the stack 12 of lumber within the bay 10 but also the considerable weight of the fork lifts which are customarily used to place and remove the lumber stack 12 within the bay 10. According to the invention, plastic pipe 50, for example, is embedded within concrete floor 44 so that water from heat exchanger 22 may be circulated during operation of the kiln. Initially when the kiln is activated the water flowing through heat exchanger 22 is at ambient temperature. Heated water from heating coils (not shown) is introduced into heat exchanger 22 to heat the air circulating in second ventilating passageway 20. Subsequently the temperature of the water circulating in plastic pipes 50 is in the range of between 160 to 180 degrees during operation of the kiln.

Figure 3A:
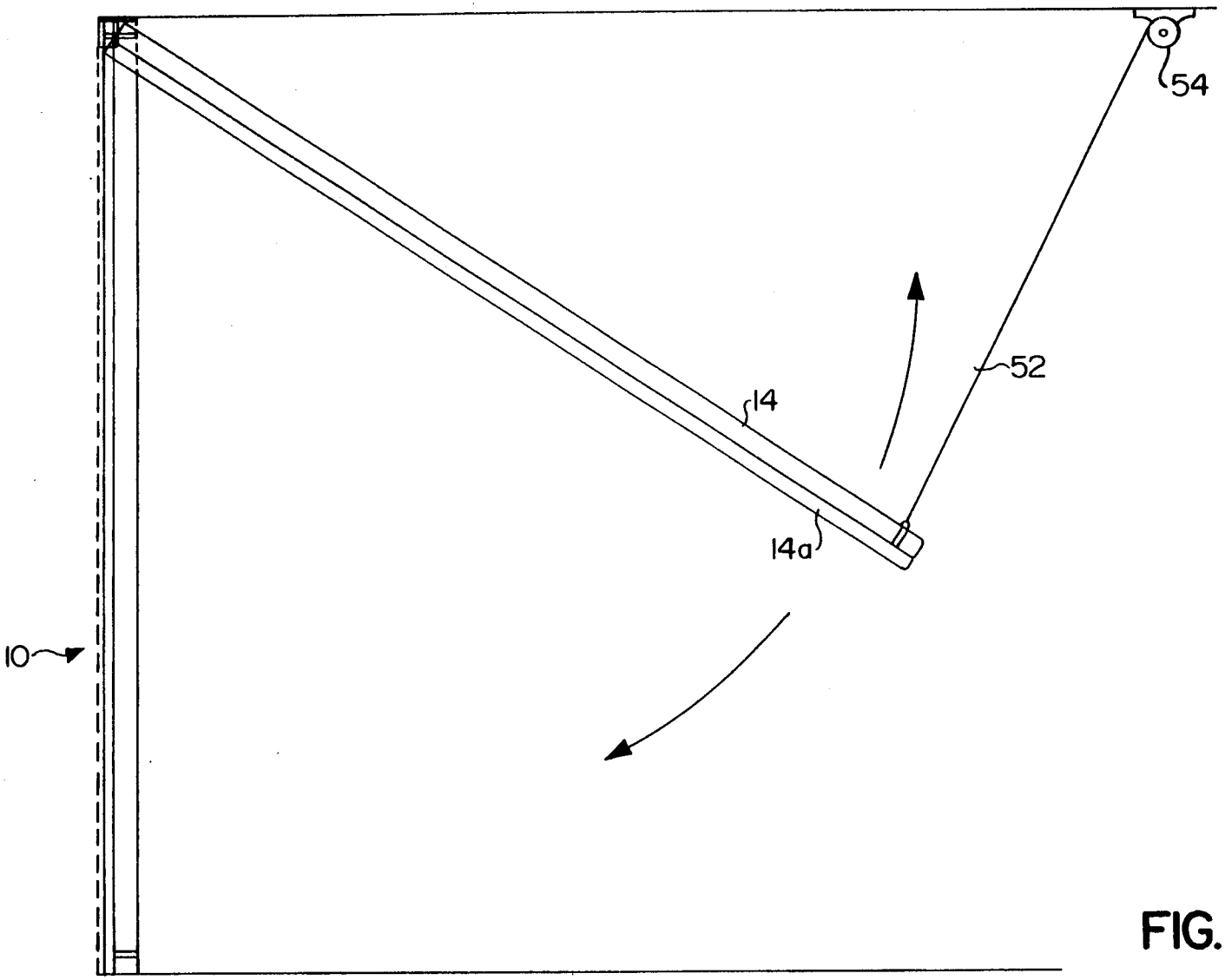
FIG. 3A is a detailed view of a hinged door for sealing a typical bay of the kiln in accordance with the invention.

FIG. 3A shows hinged door 14 capable of being lowered and raised by cable 52 through pulley 54 and which is capable of sealing bay 10 when the bay is loaded with stacked lumber to be cured. A wide seal 14*a* extends the length of door 14 on both sides and the bottom thereof to provide a seal for bay 10 and the lumber therein.

Figure 3B:
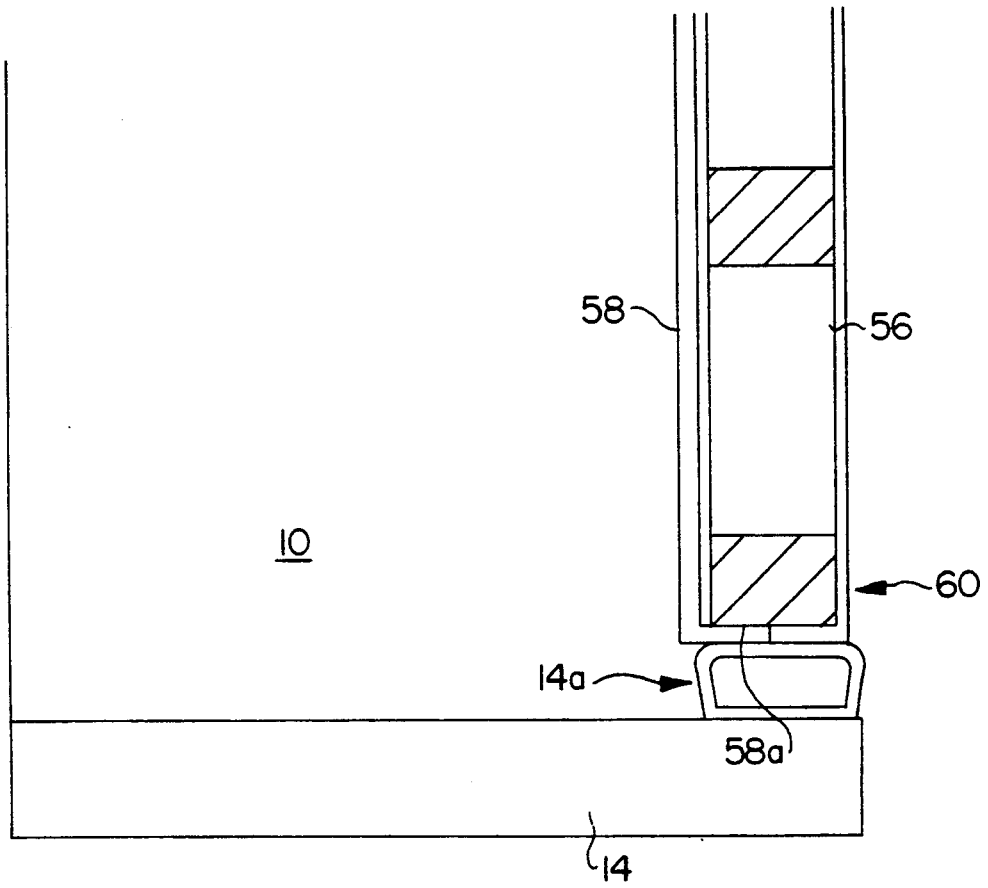
FIG. 3B is a section of a bay door showing the construction of a wall of the kiln and the relationship of the door seal and inner wall.

As shown in FIG. 3B insulated wall 56 is capped with an aluminum lining 58 to prevent corrosion. In the closed position of door 14 illustrated in FIG. 3B the end 58*a* of aluminum winding terminates approximately half way through wide seal 14*a*, thereby reducing or eliminating thermal conductivity between the ambient and the inside of bay 10.

The scope of the invention is not intended to be limited by the above-described preferred embodiment of the invention as those of ordinary skill in the wood kiln curing art will recognize that various modifications and changes can be introduced. The scope of the invention is intended to be determined from the following claims and the equivalents to which each of the components thereof are entitled.

What is claimed is:

1. A wood curing kiln, comprising:

a chamber adapted to be sealed to retain a negative pressure with respect to the ambient and for storing stacked lumber to be cured, wherein said chamber includes a concrete floor with pipe embedded therein;

means for circulating heated air within said chamber and through said stacked lumber to remove moisture therefrom;

means for constantly venting said chamber to remove moist air and maintain said negative pressure within said chamber; and, means for heating water and circulating said heated water through said embedded pipes to heat said concrete to a temperature preventing condensation on said concrete floor.

2. The wood curing kiln as claimed in claim 1, further comprising a heat exchanger mounted within said chamber to receive the water heated by said means for heating and maintaining the temperature of the air flowing from said stacked lumber to said means for circulating.

3. The wood curing kiln as claimed in claim 1, further comprising a tarp suspended from the ceiling of said chamber above said stacked lumber by means enabling said tarp to be lowered to cover and seal the top of said stacked lumber so that the heated air flows from said means for circulating across the top of said tarp and down into and through an end of said stacked lumber.

4. The wood curing kiln as claimed in claim 1, wherein said chamber includes an insulated door provided access to the chamber for loading and unloading stacked lumber and being hingeably mounted along the top thereof to a wall of said chamber and including means for sealing the door and the chamber.

5. The wood curing kiln as claimed in claim 4, wherein the walls of said chamber are lined with a non-corrosive metal to prevent corrosion and terminating approximately ½ the width of said sealing means at the door opening.

6. The wood curing kiln as claimed in claim 1, further comprising means for terminating operation of said means for venting for a specified period of time to equalize the moisture content of said stacked lumber.

7. The wood curing kiln as claimed in claim 2, further comprising a tarp suspended from the ceiling of said chamber above said stacked lumber by means enabling said tarp to be lowered to cover and seal the top of said stacked lumber so that the heated air flows from said means for circulating across the top of said tarp and down into and through an end of said stacked lumber.

8. The wood curing kiln as claimed in claim 2, wherein said chamber includes an insulated door provided access to the chamber for loading and unloading stacked lumber and being hingeably mounted along the top thereof to a wall of said chamber and including means for sealing the door and the chamber.

9. The wood curing kiln as claimed in claim 3, wherein said chamber includes an insulated door provided access to the chamber for loading and unloading stacked lumber and being hingeably mounted along the top thereof to a wall of said chamber and including means for sealing the door and the chamber.

10. The wood curing kiln as claimed in claim 2, wherein the walls of said chamber are lined with a non-corrosive metal to prevent corrosion and terminating approximately ½ the width of said means for sealing at the door opening.

11. The wood curing kiln as claimed in claim 3, wherein the walls of said chamber are lined with a non-corrosive metal to prevent corrosion and terminating approximately ½ the width of said means for sealing at the door opening.

12. The wood curing kiln as claimed in claim 2, further comprising means for terminating operation of said means for venting for a specified period of time to equalize the moisture content of said stacked lumber.

13. The wood curing kiln as claimed in claim 4, further comprising means for terminating operation of said means for venting for a specified period of time to equalize the moisture content of said stacked lumber.

14. The wood curing kiln as claimed in claim 5, further comprising means for terminating operation of said means for venting for a specified period of time to equalize the moisture content of said stacked lumber.

15. The wood curing kiln as claimed in claim 7, further comprising means for terminating operation of said means for venting for a specified period of time to equalize the moisture content of said stacked lumber.

16. The wood curing kiln as claimed in claim 8, further comprising means for terminating operation of said means for venting for a specified period of time to equalize the moisture content of said stacked lumber.

17. The wood curing kiln as claimed in claim 9, further comprising means for terminating operation of said means for venting for a specified period of time to equalize the moisture content of said stacked lumber.

18. The wood curing kiln as claimed in claim 10, further comprising means for terminating operation of said means for venting for a specified period of time to equalize the moisture content of said stacked lumber.

19. The wood curing kiln as claimed in claim 11, further comprising means for terminating operation of said means for venting for a specified period of time to equalize the moisture content of said stacked lumber.

* * * * *